US008251007B2

(12) United States Patent
Walpurgis

(10) Patent No.: US 8,251,007 B2
(45) Date of Patent: Aug. 28, 2012

(54) RESTRAINT SYSTEM FOR SECURING A USER ON A WATERCRAFT, AND WATERCRAFT HAVING A RESTRAINT SYSTEM

(75) Inventor: Peter Walpurgis, Herford (DE)

(73) Assignee: Rotinor GmbH, Stuttgart (DE)

( * ) Notice: Subject to any disclaimer, the term of this patent is extended or adjusted under 35 U.S.C. 154(b) by 81 days.

(21) Appl. No.: 12/452,628

(22) PCT Filed: Jul. 9, 2008

(86) PCT No.: PCT/EP2008/005596

§ 371 (c)(1),
(2), (4) Date: Apr. 22, 2010

(87) PCT Pub. No.: WO2009/007102

PCT Pub. Date: Jan. 15, 2009

(65) Prior Publication Data

US 2010/0236468 A1 Sep. 23, 2010

(30) Foreign Application Priority Data

Jul. 12, 2007 (DE) ..... 10 2007 032 392

(51) Int. Cl.
*B63C 11/46* (2006.01)

(52) U.S. Cl. ..... 114/315; 182/3

(58) Field of Classification Search ..... 114/315, 114/363, 364; 440/21; 70/16; 297/465, 297/473, 484, 485; 182/3, 9
See application file for complete search history.

(56) References Cited

U.S. PATENT DOCUMENTS

| | | | | |
|---|---|---|---|---|
| 1,586,595 | A | 6/1926 | Barringer | |
| 2,722,021 | A | 11/1955 | Keogh-Dwyer | |
| 3,321,247 | A * | 5/1967 | Dillender | 297/465 |
| 3,442,240 | A * | 5/1969 | Loughman et al. | 114/315 |
| 4,488,691 | A * | 12/1984 | Lorch | 297/484 |
| 5,220,976 | A * | 6/1993 | Gunter | 182/3 |
| 5,396,860 | A | 3/1995 | Cheng | |
| 5,878,687 | A | 3/1999 | Grimmeisen | |
| 6,682,372 | B2 | 1/2004 | Grimmeisen | |
| 7,329,160 | B2 | 2/2008 | Grimmeisen | |
| 2008/0269969 | A1 | 10/2008 | Bauer et al. | |
| 2008/0287016 | A1 | 11/2008 | Grimmeisen | |

FOREIGN PATENT DOCUMENTS

| | | |
|---|---|---|
| DE | 101 20 565 A1 | 11/2002 |
| DE | 10 2004 049 615 A1 | 4/2006 |
| FR | 2 799 722 | 4/2001 |
| WO | WO 96/30087 | 10/1996 |

* cited by examiner

*Primary Examiner* — Lars A Olson
(74) *Attorney, Agent, or Firm* — Pauley Petersen & Erickson

(57) ABSTRACT

A restraint system for securing a user on a watercraft, on which the user at least partially rests. The restraint system has a belt strap which is passed around the body of the user. Also, the restraint system has two stepped straps which are fitted onto the belt strap in the area of the stomach of the user and also in the area of the back of the user and are each passed through the step of the user. A connecting strap, one end of which acts on the belt strap in the area of the stomach of the user, can be fitted at its other end to the watercraft. Also, this invention relates to a watercraft having such a belt system.

30 Claims, 7 Drawing Sheets

RESTRAINT SYSTEM FOR SECURING A USER ON A WATERCRAFT, AND WATERCRAFT HAVING A RESTRAINT SYSTEM

BACKGROUND OF THE INVENTION

1. Field of the Invention

This invention relates to a restraint system for securing a user on a watercraft on which the user at least partially lies. This invention also relates to a watercraft having such a restraint system.

2. Discussion of Related Art

A watercraft with a vehicle hull is known from PCT International Publication WO 96/30087 and from German Patent Reference DE 10 2004 049 615 A1. In this case, a user places his upper body on the vehicle hull while his lower body extends out toward the rear and his legs stretch out behind him in the water. A flow conduit with a motor-driven water propeller extends inside the vehicle hull. The flow conduit extends from an influx opening in the region of the bow to the flow outlet in the stern region of the vehicle hull. The water propeller in the flow conduit is driven by a battery-powered electric motor so that a flow of water is sucked through the flow conduit and travels in the direction opposite from the travel direction of the watercraft.

It is thus possible for the water flow to be kept away from the user. In addition, the travel-induced water flow can be conveyed past the user by the vehicle hull shape. This facilitates swimming and diving with the watercraft.

If the user is lying on the vehicle hull, then he can hold onto the grip elements or recessed grips that are positioned on both sides of the vehicle hull. Controls for controlling the watercraft are integrated into the grip elements. During travel, a force is exerted on the lower body and legs of the user that threatens to pull the user rearward off the watercraft. In order to counteract this force, the user must hold onto the grip elements. Particularly when traveling longer distances and at faster speeds, this can be very strenuous.

SUMMARY OF THE INVENTION

One object of this invention is to provide a restraint system for securing the user on a watercraft that makes it possible to travel with the watercraft in a strength-saving way. This invention also discloses a watercraft having such a restraint system.

This object of the invention is attained by a restraint system with the defining characteristics taught in this specification and in the claims and by a watercraft with the defining characteristics of the dependent claims that relate to advantageous modifications of the subjects of this invention.

Accordingly, one restraint system has a belt strap that can be placed around the user's trunk and secured there like a belt in the hip region. In addition, two crotch straps each is attached to the belt strap at one end in the region of the user's stomach and at the other end in the region of the user's back, and can each be guided through the user's crotch, achieving a comfortable support in the region of the user's buttocks.

A connecting strap, one end of which acts on the belt strap in the region of the user's stomach, can be attached to the watercraft at its other end.

The connecting strap produces a connection between the user and the watercraft that is secure in the traction direction and movable thereto in the direction transverse. The lateral freedom of movement required for controlling the watercraft is retained, but the tractive forces that act on the lower body and legs of the user while traveling through the water are absorbed by the connecting strap in the traction direction. This makes it possible to travel with the watercraft in a strength-saving way.

In order to achieve a stable connection between the belt strap and the connecting strap, a fastening element can be attached in the region of the user's stomach and is acted on in turn by the connecting strap. Alternatively, however, the connecting strap can also be fastened directly to the belt strap.

The connecting strap can extend perpendicularly from the belt strap in a direction toward the user's chest in order to permit a coupling to the watercraft in the user's chest region.

In order to achieve an easy-to-use attachment to the watercraft, the end of the connecting strap associated with the watercraft can have a receptacle for an eyelet, a pin, a carabineer, a pushbutton, or a similar securing element. The securing element is used for securing to an attachment point on the watercraft.

In order to permit the user to easily step into the arrangement of the two crotch straps, with each leg guided through a loop defined by each crotch strap and the belt strap, the two crotch straps can be fastened to each other in the region of the user's crotch, on their outer surfaces oriented away from the user.

To permit the restraint system to be adapted to users of different heights and different physiques, the belt strap and/or the crotch straps and/or the connecting strap can be adjustable in length.

The watercraft, which has a vehicle hull on which the user at least partially lies, can have a restraint system.

In this case, the vehicle hull can have a lying surface on top for the user, on which the user places his upper body against the watercraft.

The connecting strap can have its attachment point to the vehicle hull in the region of the lying surface. Alternatively, the connecting strap can have its attachment point to the vehicle hull in the region that adjoins the lying surface in the direction toward the user's feet. This arrangement permits a particularly comfortable attachment of the connecting strap to the vehicle because the user, when in the prone position, does not end up lying on the attachment point.

According to a particularly advantageous embodiment of this invention, the attachment point of the connecting strap to the vehicle hull can be situated in the central longitudinal plane of the watercraft. This measure effectively prevents the transmission of torques during travel.

In order to achieve a particularly good maneuverability of the watercraft, the attachment point of the connecting strap to the vehicle hull can be situated in the region of the watercraft's center of gravity.

To provide the user with good mobility during travel, particularly in the transverse direction to the vehicle, the connecting strap can be supported on the vehicle hull to allow it to rotate around an axis extending essentially perpendicular to the vehicle hull.

In order to permit the quickest possible detachment of the connecting strap from the watercraft in the event of danger, a quick-release fastener or quick-acting fastener can be provided between the connecting strap and the vehicle hull.

BRIEF DESCRIPTION OF THE DRAWINGS

This invention is explained in detail below in view of a preferred exemplary embodiment with reference to the accompanying drawings, wherein.

DETAILED DESCRIPTION OF THE INVENTION

Figure 1:
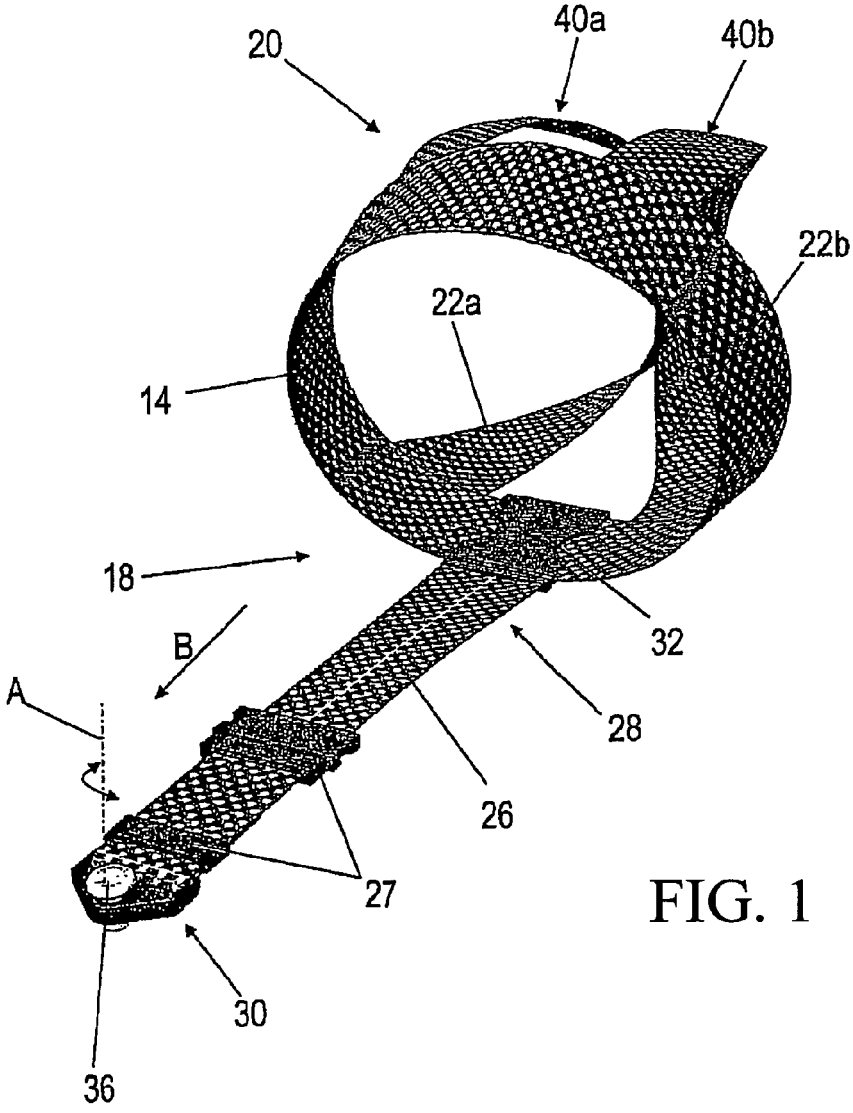
FIG. 1 is a schematic, perspective side view of a restraint system.
Figure 2:
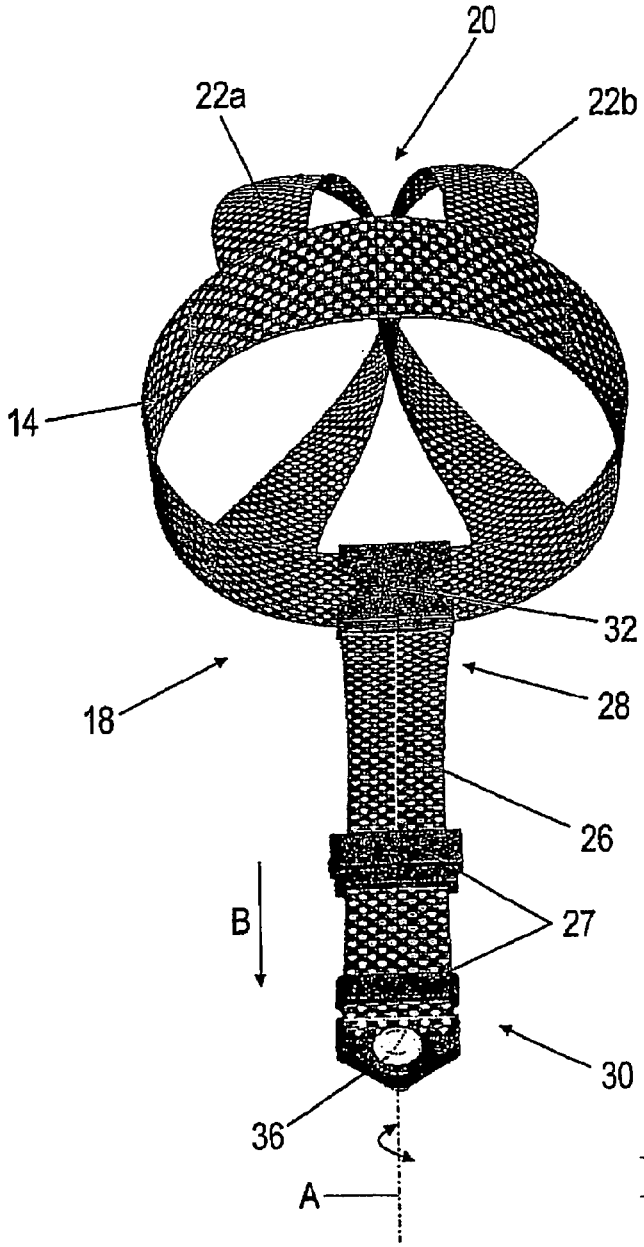
FIG. 2 is a schematic, perspective top view of the restraint system shown in FIG. 1.
Figure 3:
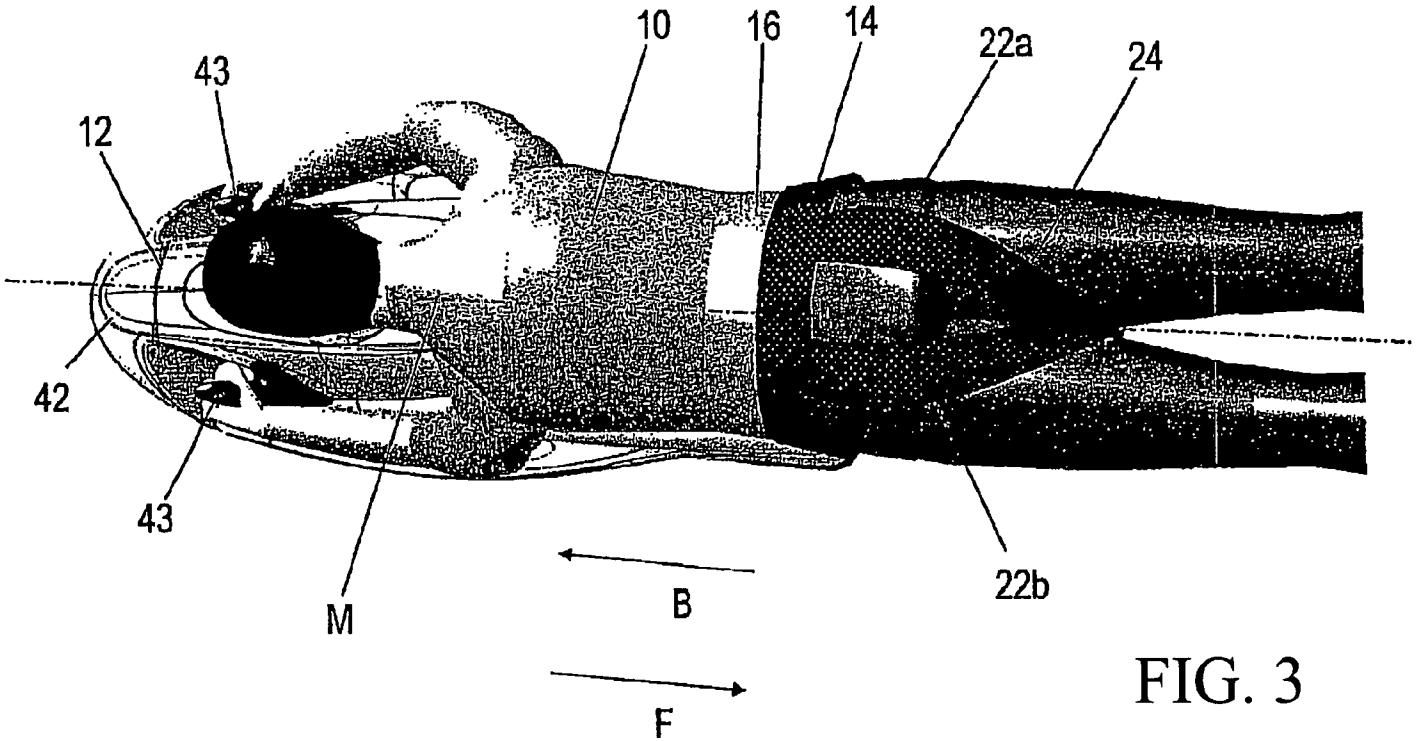
FIG. 3 is a schematic, perspective top view of a watercraft on which a user is lying in a travel position, with the user secured to the watercraft by the restraint system shown in FIGS. 1 and 2.
Figure 4:
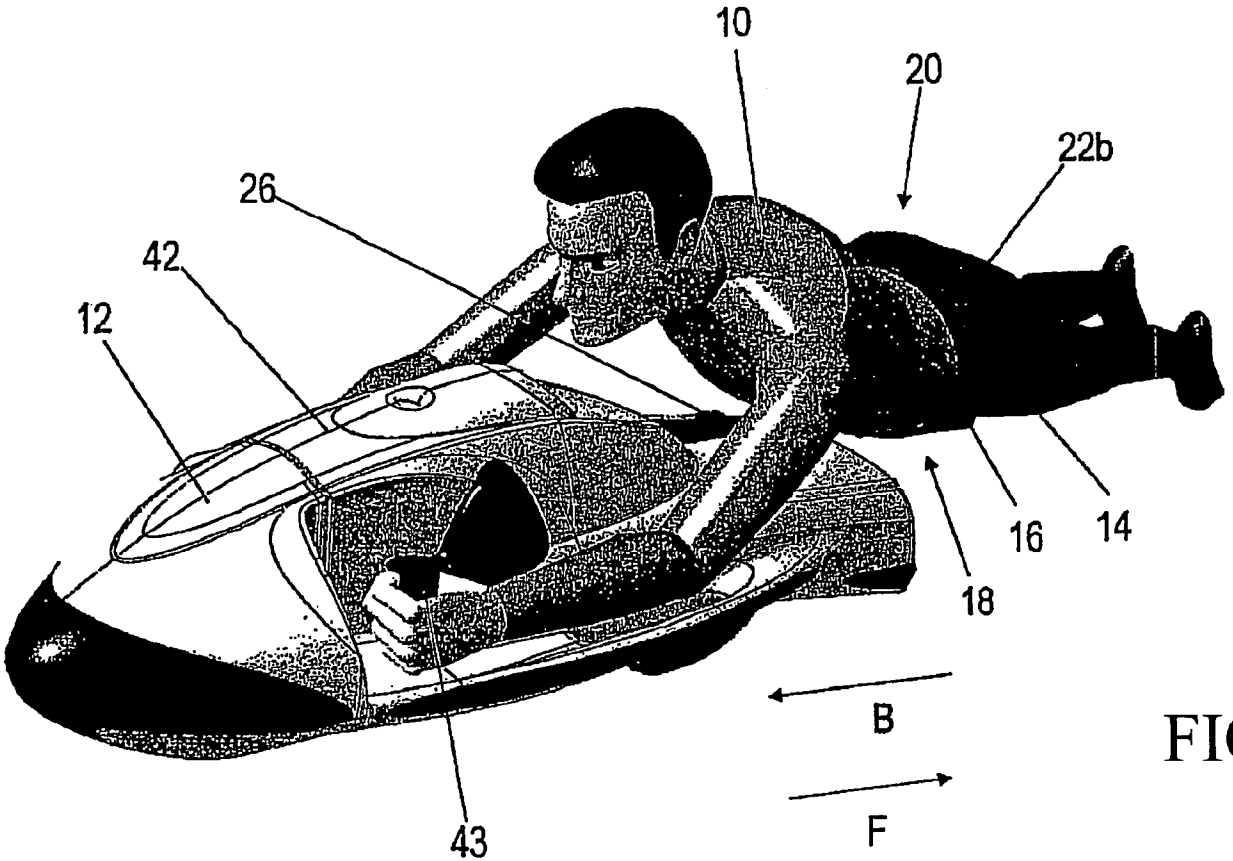
FIG. 4 is a schematic, perspective top view of the watercraft shown in FIG. 4, on which the user is lying in the travel position.
Figure 5:
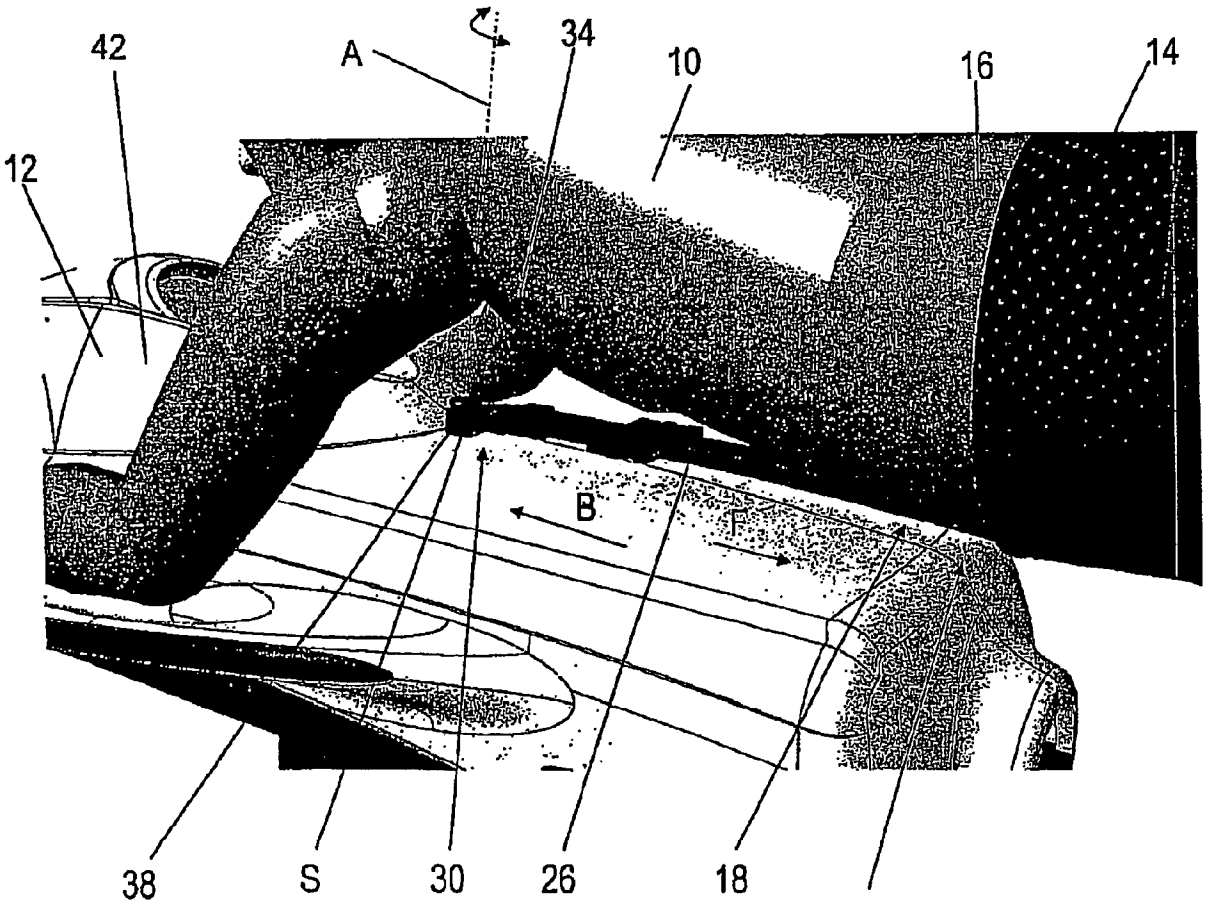
FIG. 5 is a schematic, perspective side view of an enlarged partial view of the watercraft shown in FIGS. 3 and 4 on which the user is lying in the travel position.

FIGS. 1 and 2 are schematic depictions of different perspective views of a restraint system. FIGS. 3 through 5 show different perspective views of a watercraft 12 that is equipped with or having this restraint system for securing a user 10 to the watercraft 12.

The restraint system essentially comprises an arrangement of textile belts that have essentially no tensile elasticity. Synthetic materials are particularly suitable for use as the textile material because they maintain their material properties even when in contact with water.

The restraint system has a belt strap 14 that can be placed around the trunk 16 of the user 10, like a belt. The belt strap 14 is adjustable in length but the adjusting mechanism is not shown. In the region 18 of the stomach of the user 10, two crotch straps 22*a* and 22*b* are each stitched to the belt strap 14 at one end, spaced a short distance apart from each other. The two crotch straps 22*a* and 22*b* can be guided through the crotch 24 of the user 10 and at their other ends, are stitched to the belt strap 14 in the region of or near the back of the user 10. The two crotch straps 22*a* and 22*b* are fastened to each other in the region of the crotch 24 of the user 10, on their outer surfaces 40*a* and 40*b* oriented away from the user 10. The two crotch straps 22*a* and 22*b* are adjustable in length but the adjusting mechanism is not shown.

In the region 18 of the stomach of the user 10, the one end 28 of a connecting strap 26 is attached to a fastening element 32. The fastening element 32 is in turn attached to the belt strap 14. The fastening element 32 in this case is situated or positioned between the crotch straps 22*a* and 22*b* whose ends are stitched to the belt strap 14. The connecting strap 16 extends from the belt strap perpendicularly in the direction toward the chest 34 of the user 10, which is indicated in the drawings by the arrow B. The connecting strap 26 is adjustable in length and the adjusting mechanism 27 is shown in FIGS. 1 and 2.

At its other end 30, the connecting strap can be fastened to the watercraft 12. For this purpose, the end 30 of the connecting strap 26 associated with the watercraft 12 has a receptacle 36 for a pin for securing to an attachment point 38 on the watercraft 12.

Alternatively, the receptacle 36 can accommodate an eyelet, a carabineer, a pushbutton, or a similar securing element.

The watercraft 12 shown in FIGS. 3 through 5 has a vehicle hull 42 on which the user 10 places his chest region 34. In this position, the user can grasp grip elements 43 or recessed grips situated on both sides of the vehicle hull 42. Controls of the watercraft 12 are integrated into the grip elements 43.

The vehicle hull 42 has a lying surface 44 on top for the user 10. The connecting strap 26 is connected to the vehicle hull 42 at the attachment point 38 in the region that adjoins the lying surface 44 in the direction toward the feet 46 of the user 10, which is indicated by the arrow F in the drawings. A quick-release fastener or quick-acting fastener, shown in more detail in FIGS. 6 through 9, is provided at the attachment point 38 between the connecting strap 26 and the vehicle hull 42.

The attachment point 38 of the connecting strap 26 to the vehicle hull 42 is situated or positioned in the central longitudinal plane M of the watercraft 12, which is indicated by the dot-and-dash line M in FIG. 3. In FIG. 3, the central longitudinal plane M extends perpendicular to the plane of the drawing. In addition, the attachment point 38 of the connecting strap 26 to the vehicle hull 42 is situated in the region of the center of gravity S of the watercraft.

As clear from FIG. 5 taken in conjunction with FIGS. 1 and 2, the connecting strap 26 is supported on the vehicle hull 42 so that it rotates around an axis A extending essentially perpendicular to the central longitudinal axis of the vehicle hull 42.

FIGS. 6 through 9 show an exemplary embodiment of the above-mentioned quick-release fastener. As shown, to produce the attachment point 38, a recess 38.1 is let into the vehicle hull 42. For example, the recess 38.1 is formed into the region of the lying surface 44 in an integral fashion and is thus watertight. The recess 38.1 encompasses a receptacle 38.5 that is accessible through an opening 38.6. An insert 38.2 is mounted in this receptacle 38.5 and fastened to the recess 38.1. In this case, a threaded connection 38.3 is depicted between the sidewall, which encompasses the receptacle 38.5, and the outer contour of the insert 38.2. It would also be possible to glue the insert 38.2 into the receptacle 38.5.

The insert 38.2 has one or more detent elements 38.4, in the present case a detent edge. The detent elements 38.3 and the detent element 38.4 have an insertion bevel that transitions into a steeply inclined detent flank. The detent flank engages behind detent bevels of second latching elements 36.3 of the receptacle part 36.

Figure 6:
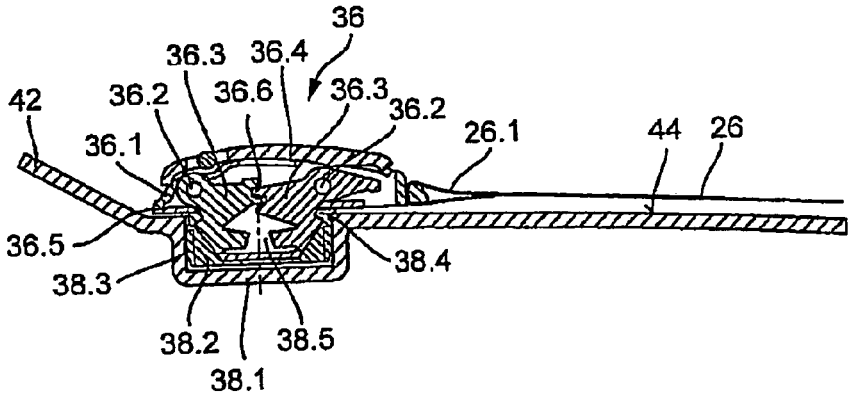
FIGS. 6 through 9 are partial views from the side of the connection between the restraint system and the watercraft, in various operating positions.

The receptacle part 36 has a holding part 36.1 that can, for example, be a housing. The two latching elements 36.3 are fastened to the holding part 36.1 by pivot bearings 36.2. A spring which is not shown acts on the two latching elements 36.3 so that the latching elements are held in the splayed position shown in FIG. 6. The right latching element 36.3 shown in FIG. 6 is coupled to a release lever 36.4 that is secured to the holding part 36.1 in a pivotable fashion. The release lever 36.4 has a grip 36.5.

Figure 7:
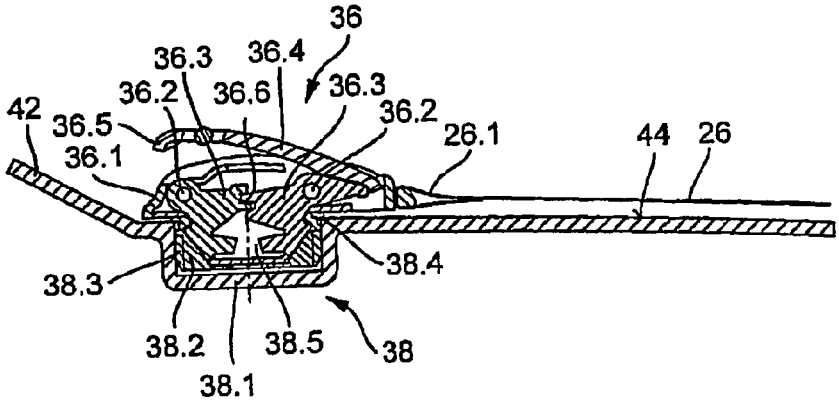
Figure 8:
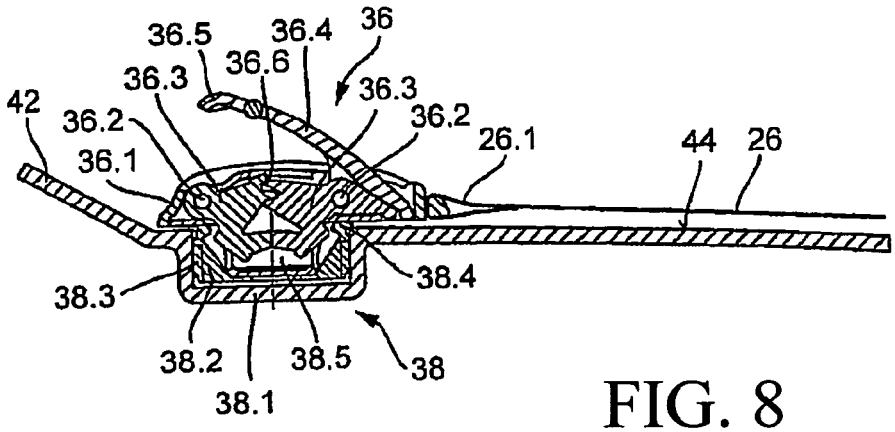
Figure 9:
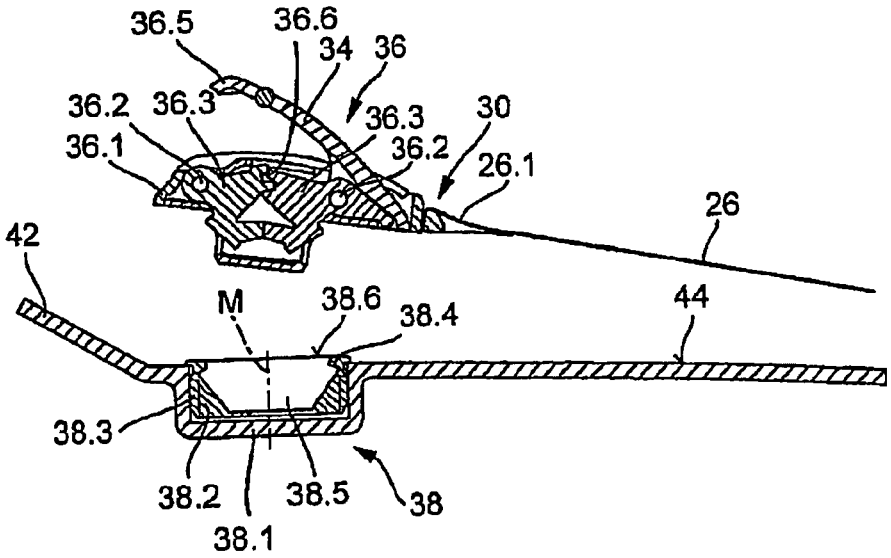

Starting from the latched position shown in FIG. 6, in which the receptacle part 36 is detent-engaged in the attachment point 38, the release lever 36.4 can be pivoted upward at its grip 36.5 until it is operatively connected to the right latching element 36.3. Then the operating position shown in FIG. 7 is reached. With a continued pivoting of the release lever 36.4, the two latching elements 36.3 are pivoted around the pivot bearings 36.2 so that they disengage from the detent element 38.4, as shown in FIG. 8. The right latching element drives the left latching element 36.3 by a denticulation 36.6. When the release lever 36.4 is pivoted all the way open, the receptacle part can be lifted out of the attachment point 38, out of the insert 36.2, as shown in FIG. 9. When the release lever 36.4 is released, it is moved back into the starting position shown in FIG. 6 through the action of a spring that is not shown. The two spring-prestressed latching elements 36.3 also return to their starting positions according to FIG. 6.

The coupling of the receptacle part 36 to the attachment point 38 occurs in a simple fashion. It is only necessary to press the receptacle part 36 into the insert 38.2. During this, inclined surfaces of the latching elements 36.3 come into contact with the insertion bevels of the detent elements 38.4. As a result, the latching elements 36.3 are pivoted radially inward in opposition to the spring prestressing. When the inclined surfaces have moved past the insertion bevels, counterpart surfaces of the latching elements 36.3 snap behind the detent flanks of the latching elements 36.3 so that the mounted position shown in FIG. 6 is produced.

As is particularly clear from FIG. 9, the counterpart surfaces and detent flanks are inclined in relation to the central longitudinal axis 11 of the insert 38.2 at an angle <90°. It is thus possible to implement a panic release. Employed in this way, when an impermissibly powerful traction is exerted on the connecting strap 26, the latching elements 36.2 can be automatically deflected inward and the connection to the attachment point 38 can be released.

To improve usability, the receptacle part 36 can be rotated in the insert 38.2 around the central longitudinal axis 11.

As shown in FIGS. 6 through 9, the connecting strap 26 is coupled directly to an eyelet of the holding part 36.1 by a stitched loop 26.1.

The invention claimed is:

1. A restraint system for securing a user (10) to a watercraft (12) on which the user (10) at least partially lies, the restraint system comprising:

a belt strap (14) positionable around a trunk (16) of the user (10), two crotch straps (22*a*, 22*b*) each attached to the belt strap (14) at one end in a first region (18) of a stomach of the user (10) and at an other end in a second region (20) of a back of the user (10) and each is guidable through a crotch (24) of the user (10), and a connecting strap (26) having one end (28) attached to the belt strap (14) in the first region (18) of the stomach of the user (10) and at an other end (30) includes a securing element attachable to an attachment point (38) on the watercraft (12).

2. The restraint system as recited in claim 1, wherein in the first region (18) of the stomach of the user (10), a fastening element (32) is attached, which is acted on by the connecting strap (26).

3. The restraint system as recited in claim 2, wherein the connecting strap (16) extends perpendicularly from the belt strap in a direction (B) toward a chest (34) of the user (10).

4. The restraint system as recited in claim 3, wherein an end (30) of the connecting strap (26) associated with the watercraft (12) has a receptacle (36) for an eyelet, a pin, a carabineer, a pushbutton, or a similar securing element for securing to an attachment point (38) on the watercraft (12).

5. The restraint system as recited in claim 4, wherein two crotch straps (22*a*, 22*b*) are fastened to each other in a region of the crotch (24) of the user (10), on outer surfaces (40*a*, 40*b*) oriented away from the user (10).

6. The restraint system as recited in claim 5, wherein the belt strap (14) is adjustable in length.

7. The restraint system as recited in claim 6, wherein the crotch straps (22*a*, 22*b*) are adjustable in length.

8. The restraint system as recited in claim 7, wherein the connecting strap (26) is adjustable in length.

9. The restraint system as recited in claim 8, for a watercraft (12) with a vehicle hull (42) on which the user (10) at least partially lies.

10. The restraint system as recited in claim 9, wherein the vehicle hull has a lying surface (44) on a top for the user (10).

11. A restraint system for securing a user to a watercraft (12) on which the user (10) at least partially lies, the restraint system comprising:

a belt strap (14) positionable around a trunk (16) of the user (10), two crotch straps (22*a*, 22*b*) each attached to the belt strap (14) at one end in a first region (18) of a stomach of the user (10) and at an other end in a second region (20) of a back of the user (10) and each is guidable through a crotch (24) of the user (10); and a connecting strap (26) having one end (28) acting on the belt strap (14) in the first region (18) of the stomach of the user (10) and at an other end (30) attachable to the watercraft (12);

wherein the connecting strap (26) has an attachment point (38) to a vehicle hull (42) in a region of a lying surface (44).

12. The restraint system as recited in claim 11, wherein the connecting strap (26) has the attachment point (38) to the vehicle hull (42) in the region that adjoins the lying surface (44) in the direction (F) toward feet (46) of the user (10).

13. The restraint system as recited in claim 12, wherein the attachment point (38) of the connecting strap (26) to the vehicle hull (42) is situated in a central longitudinal plane (M) of the watercraft (12).

14. The restraint system as recited in claim 13, wherein the attachment point (38) of the connecting strap (26) to the vehicle hull (42) is situated in the region of a center of gravity (S) of the watercraft.

15. The restraint system as recited in claim 14, wherein the connecting strap (26) is supported on the vehicle hull (42) to rotate around an axis (A) extending essentially perpendicular to the vehicle hull (42).

16. The restraint system as recited in claim 15, wherein a quick-release fastener or quick-acting fastener is provided between the connecting strap (26) and the vehicle hull (42).

17. The restraint system as recited in claim 1, wherein the connecting strap (16) extends perpendicularly from the belt strap in a direction (B) toward a chest (34) of the user (10).

18. The restraint system as recited in claim 1, wherein an end (30) of the connecting strap (26) associated with the watercraft (12) has a receptacle (36) for an eyelet, a pin, a carabineer, a pushbutton, or a similar securing element for securing to an attachment point (38) on the watercraft (12).

19. The restraint system as recited in claim 1, wherein two crotch straps (22*a*, 22*b*) are fastened to each other in a region of the crotch (24) of the user (10), on outer surfaces (40*a*, 40*b*) oriented away from the user (10).

20. The restraint system as recited in claim 1, wherein the belt strap (14) is adjustable in length.

21. The restraint system as recited in claim 1, wherein the crotch straps (22*a*, 22*b*) are adjustable in length.

22. The restraint system as recited in claim 1, wherein the connecting strap (26) is adjustable in length.

23. The restraint system as recited in claim 1, for a watercraft (12) with a vehicle hull (42) on which the user (10) at least partially lies.

24. The restraint system as recited in claim 23, wherein the vehicle hull has a lying surface (44) on a top for the user (10).

25. A restraint system for securing a user (10) to a watercraft (12) on which the user (10) at least partially lies, the restraint system comprising:

a belt strap (14) positionable around a trunk (16) of the user (10), two crotch straps (22*a*, 22*b*) each attached to the belt strap (14) at one end in a first region (18) of a stomach of the user (10) and at an other end in a second region (20) of a back of the user (10) and each is guidable through a crotch (24) of the user (10);

a connecting strap (26) having one end (28) acting on the belt strap (14) in the first region (18) of the stomach of the user (10) and at an other end (30) attachable to the watercraft (12); and wherein the watercraft (12) includes a vehicle hull (42) on which the user (10) at least partially lies and the connecting strap (26) has an attachment point (38) to the vehicle hull (42) in the region of the lying surface (44).

26. The restraint system as recited in claim 25, wherein the connecting strap (26) has the attachment point (38) to the vehicle hull (42) in the region that adjoins the lying surface (44) in the direction (F) toward feet (46) of the user (10).

27. The restraint system as recited in claim 25, wherein the attachment point (38) of the connecting strap (26) to the vehicle hull (42) is situated in a central longitudinal plane (M) of the watercraft (12).

28. The restraint system as recited in claim 25, wherein the attachment point (38) of the connecting strap (26) to the vehicle hull (42) is situated in the region of a center of gravity (S) of the watercraft.

29. The restraint system as recited in claim 1, wherein the connecting strap (26) is supported on a vehicle hull (42) of the watercraft (12) to rotate around an axis (A) extending essentially perpendicular to the vehicle hull (42).

30. The restraint system as recited in claim 1, wherein the watercraft (12) includes a hull (42) with a lying surface (44) on which a user (10) at least partially lies, wherein the vehicle hull (42) includes the attachment point (38) in a region of the lying surface, wherein the attachment point (38) has detent elements with inclined surfaces for a snap in connection of a quick-release fastener or quick-acting fastener of a restraint system.

* * * * *